US011490749B2

(12) United States Patent
Carder

(10) Patent No.: US 11,490,749 B2
(45) Date of Patent: Nov. 8, 2022

(54) NESTED TABLEWARE SET

(71) Applicant: Lenox Corporation, Bristol, PA (US)

(72) Inventor: Timothy Carder, New Hope, PA (US)

(73) Assignee: Lenox Corporation, Bristol, PA (US)

( * ) Notice: Subject to any disclaimer, the term of this patent is extended or adjusted under 35 U.S.C. 154(b) by 0 days.

(21) Appl. No.: 17/078,962

(22) Filed: Oct. 23, 2020

(65) Prior Publication Data

US 2021/0120986 A1 Apr. 29, 2021

Related U.S. Application Data

(60) Provisional application No. 62/925,522, filed on Oct. 24, 2019.

(51) Int. Cl.
*A47G 19/02* (2006.01)
*B65D 21/02* (2006.01)

(52) U.S. Cl.
CPC ..... *A47G 19/02* (2013.01); *B65D 21/0233* (2013.01)

(58) Field of Classification Search
CPC ..... A47G 19/02; A47G 19/23; A47G 19/00; B65D 21/0233; B65D 21/0234
USPC ..... 206/514, 541, 509, 501–504, 511; 220/23.83; D7/505
See application file for complete search history.

(56) References Cited

U.S. PATENT DOCUMENTS 1,908,806 A * 5/1933 Allen ..... A47J 27/13 99/339
3,749,278 A * 7/1973 von Boch-Galhau ..... A47G 19/00 220/23.83
D256,205 S 8/1980 Bateman et al.
D272,223 S 1/1984 Daenen
4,793,491 A * 12/1988 Wolf ..... B65D 85/84 206/509
4,892,213 A 1/1990 Mason, Jr.
D309,690 S 8/1990 Carlson
(Continued)

FOREIGN PATENT DOCUMENTS

CN 2861030 Y 1/2007
CN 303105600 A 2/2015
(Continued)

OTHER PUBLICATIONS

"The Dabbling Crafter", http://www.thedabblingcrafter.com/2014/09/show-tell-displaying-vintage-pyrex.html, Sep. 12, 2014.
(Continued)

*Primary Examiner* — Andrew D Perreault

(57) ABSTRACT

A nested tableware set includes: a) first and second bowls having a base and container portion that terminates at an open rim, and b) a plate interposed between the first and second bowls. Each plate has: 1) a base terminating at a side wall that extends upwardly and terminates at a side wall rim, 2) a base wall extending vertically downwardly from the base, 3) a first annular surface extending horizontally away from an upper end of the base wall, and 4) a second annular surface extending horizontally away from and vertically above the first annular surface. The first annular surface and the base wall together define a first shelf for seating the first bowl, and the second annular surface defines a second shelf for seating another plate. The base and side wall together define a third shelf for seating the second bowl.

9 Claims, 4 Drawing Sheets

(56) References Cited

U.S. PATENT DOCUMENTS

| | | | |
|---|---|---|---|
| 5,139,166 | A | 8/1992 | Smith |
| 6,047,845 | A | 4/2000 | Rapaz |
| D450,219 | S | 11/2001 | Smith |
| 7,021,480 | B2 | 4/2006 | Yu |
| D539,093 | S | 3/2007 | Robinson |
| D547,119 | S | 7/2007 | Robinson |
| D574,188 | S | 8/2008 | Beny |
| D611,774 | S | 3/2010 | Yung |
| D650,241 | S | 12/2011 | Ehrenhaus et al. |
| D650,243 | S | 12/2011 | Abrams |
| D674,666 | S | 1/2013 | Pallotto |
| D701,088 | S | 3/2014 | Hone |
| D709,335 | S | 7/2014 | Stamatopoulos |
| 8,993,022 | B1 | 3/2015 | Hertz |
| 9,102,439 | B2 | 8/2015 | Kemper et al. |
| D749,371 | S | 2/2016 | Kolano |
| 10,149,562 | B2 | 12/2018 | Bell et al. |
| D845,714 | S | 4/2019 | Wands |
| 2007/0017915 | A1 | 1/2007 | Weder et al. |
| 2012/0181269 | A1 | 7/2012 | Rubenson et al. |
| 2018/0037365 | A1 | 2/2018 | Battaglia |
| 2019/0100367 | A1 | 4/2019 | Grove et al. |

FOREIGN PATENT DOCUMENTS

| | | | |
|---|---|---|---|
| CN | 206333687 | U | 7/2017 |
| CN | 208731521 | U | 4/2019 |
| EP | 002056549-0002 | A | 10/2012 |
| KR | 3005994060000 | A | 5/2011 |
| KR | 3006092480000 | A | 8/2011 |
| KR | 3007398230000 | A | 4/2014 |
| KR | 3007586090000 | A | 8/2014 |
| KR | 3007686330000 | A | 11/2014 |
| KR | 3007778730000 | A | 12/2014 |
| WO | 2019106356 | A1 | 6/2019 |
| WO | 2019113520 | A1 | 6/2019 |

OTHER PUBLICATIONS

"Upside-Down Beverage Containers-2," https://bestinpackaging.com/2015/02/26/upside-down-beverage-containers-02/, Feb. 28, 2015.

"Dark Grey Food Grade Melamine Babel Drink Stackable Tumbler Set," https://www.trouva.com/products/ibride-dark-grey-food-grade-melamine-babel-drink-stackable-tumbler-set?algoliaQueryID=aba872db4d74624bb6b0fde2181778d1&algoliaObjectID=5dad9ad2c93aae0003f8f219, (3 pages), Jul. 2, 2019.

* cited by examiner

NESTED TABLEWARE SET

CROSS-REFERENCE TO RELATED APPLICATION

This application claims priority under 35 U.S.C. § 119(e) from U.S. Provisional Patent Application No. 62/925,522, filed on Oct. 24, 2019.

FIELD OF THE INVENTION

This disclosure relates generally to tableware used for serving and eating meals, and more particularly, to a tableware set including plates and bowls that can be assembled in a nested cluster having decorative features.

BACKGROUND

Current trends in kitchen and dining area design are embracing open shelving and other design elements that convey a sense of airiness, simplicity and reduced clutter.[1] As a result, various kitchen and dining implements that were invisibly stored away in traditional cabinet and drawer systems are now finding their way out into the open—for example, including stacks of tableware such as howls and plates. These tableware stacks may consume precious space, and are often not aethetically pleasing.

[1] See e.g., M. Valeris, "The Biggest Kitchen Design Trends For 2019," ELLE DECOR, Aug. 26, 2019 (available at https://www.elledecor.com/design-decorate/trends/g23693937/kitchen-trends-2019/, last visited Oct. 21, 2019).

It would be beneficial to develop a tableware set that can be efficiently stored, visible in an open environment, in an aethestically pleasing configuration.

SUMMARY

By way of example, aspects of the present disclosure are directed to disclose a novel tableware set, including plates and bowls and which can be configured in a nested arrangement that is compact, visually attractive and aesthetically pleasing.

In accordance with aspects of the present disclosure, the disclosed tableware set includes: a) first and second bowls, each having a base supporting a container portion that extends away from the base and terminates at an open rim, and b) at least one plate configured to be interposed between the first and second vessels. Each plate has: 1) a base extending and outwardly terminating at a side wall that extends upwardly from the base and terminates at a side wall rim, 2) a base wall extending vertically downwardly from a lower surface of the base, 3) a first annular surface extending horizontally and radially outwardly away from an upper end of the base wall, and 4) a second annular surface positioned vertically above the first annular surface and extending horizontally and radially outwardly away from the first annular surface. The first annular surface and the base wall together define a first shelf configured for seating the rim of the first bowl, and the second annular surface defines a second shelf for seating the side wall rim of another plate. The base and side wall together define a third shelf for seating the rim of the second bowl. The side wall of the at least one plate defines a band that extends outwardly from and around the first and second bowls.

In accordance with an additional aspect of the disclosure, the tableware set further includes at least two additional bowls that are positioned in a nested relationship to the first and second bowls.

In accordance with further aspects of the disclosure, the tableware set includes two additional bowls nested with each of the first and second bowls.

In accordance with further aspects of the disclosure, the tableware set includes at least two plates.

In accordance with other aspects of the disclosure, perimeters of the rims of each of the bowls and at least one plate are circular.

This SUMMARY is provided to briefly identify some aspects of the present disclosure that are further described below in the DESCRIPTION. This SUMMARY is not intended to identify key or essential features of the present disclosure nor is it intended to limit the scope of any claims.

BRIEF DESCRIPTION OF THE DRAWING

A more complete understanding of the present disclosure may be realized by reference to the accompanying drawing in which.

DETAILED DESCRIPTION

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements later developed that perform the same function, regardless of structure.

Unless otherwise explicitly specified herein, the drawings are not drawn to scale.

Aspects of the present disclosure are directed to the elements of a nested tableware set. An exemplary tableware set 100 is depicted an exploded view depicted in FIG. 1. The tableware set 100 as shown includes two bowl sets each including a large bowl 102*a*, 102*b*, a medium bowl 104*a*, 104*b* and a small bowl 106*a*, 106*b*. When combined into a display configuration, each small bowl is nested within a medium bowl 104*a*, 104*b*, which is in turn nested within a large bowl 102*a*, 102*b*. Each bowl set is positioned in mirror image opposition to the other, and lower and upper plates 108*a*, 108*b*) are stacked and positioned between the two bowl sets, which then are locatably positioned on an upper surface of the upper plate 108*b* and a lower surface of the lower plate 108*a*, respectively. While the table set illustrated in FIG. 1 includes two bowl sets having three bowls each and two plates, one having skill in the art will readily recognize that each bowl set may be configured with a greater or lesser number of bowls (including a set configured with only a single bowl), and that the number of nested plates may range from one to a greater number.

Figure 1:
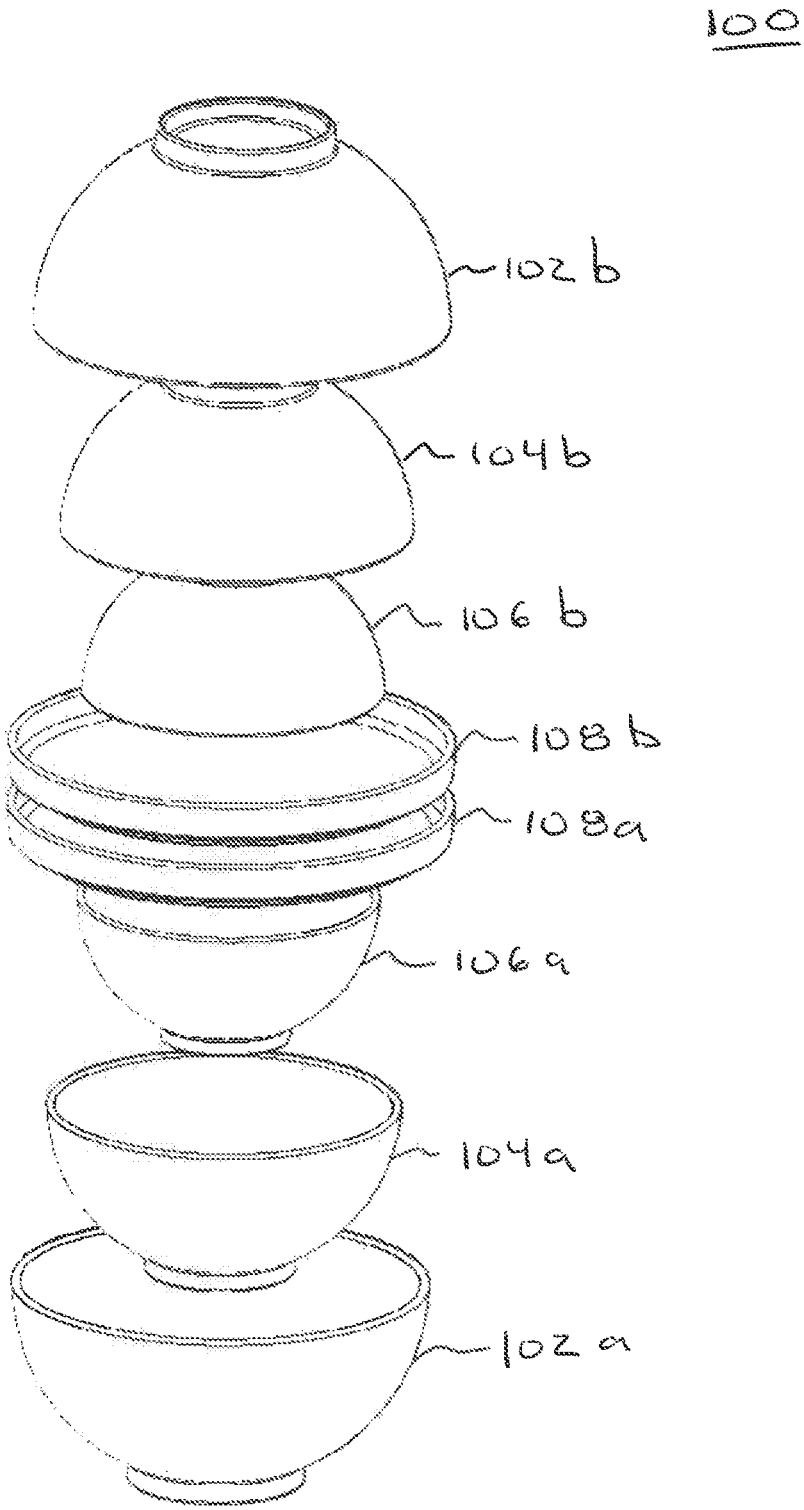
FIG. 1 illustrates an exploded view of an exemplary nested tableware set in accordance with aspects of the present disclosure.
Figure 2:
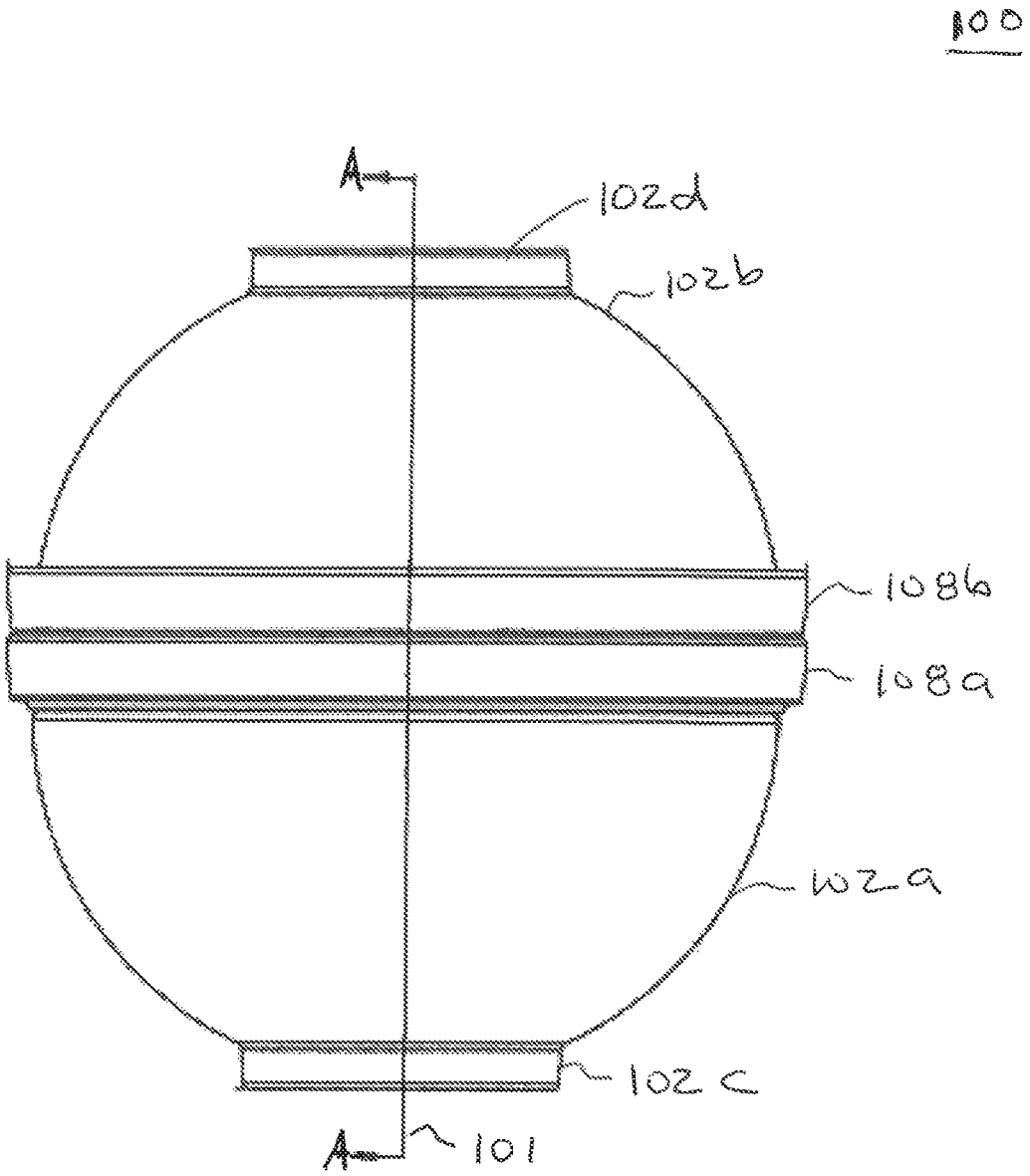
FIG. 2 illustrates the exemplary nested tableware set of FIG. 1 with the pieces of the set arranged in a nested state.

FIG. 2 shows the exemplary tableware set 100 of FIG. 1 as arranged in is display configuration. When bowls 102*a*, 102*b* and plates 108*a*, 102*b* are made of an opaque material, bowls 104*a*, 104*b*, 106*a* and 106*b* are not visible in the display configuration. Plates 108*a*, 108*b* and bowls 102*a*, 102*b*, 104*a*, 104*b*, 106*a* and 106*b* may be formed from one or more of a variety of materials, including for example, ceramic, plastic, metal and/or organic materials such as wood. While illustrated as having external surfaces that are circular with reference to a longitudinal axis 101 of the tableware set 100, one having skill in the art will readily recognize that the external surfaces of Plates 108*a*, 108*b* and bowls 102*a*, 102*b*, 104*a*, 104*b*, 106*a* and 106*b* may also be square, rectangular, or polygonal, or alternatively assume any other closed-form periphery.

Figure 3A:
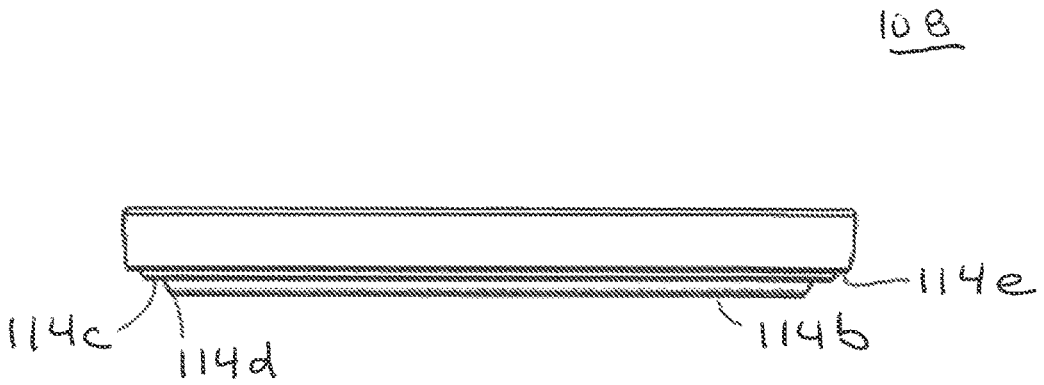
FIG. 3*a* illustrates an exemplary plate included in the nested tableware set of FIG. 1.
Figure 3B:
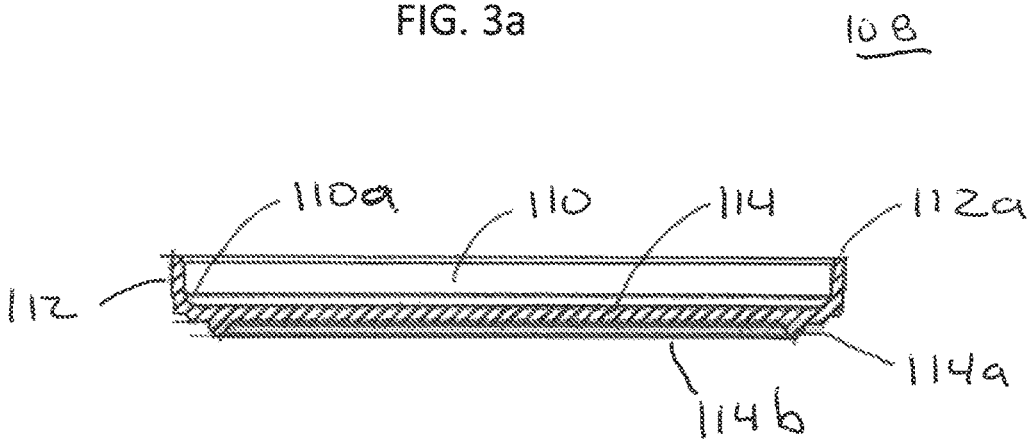
FIG. 3*b* a provides a cross-sectional view of the exemplary plate of FIG. 3*a;*
Figure 3C:
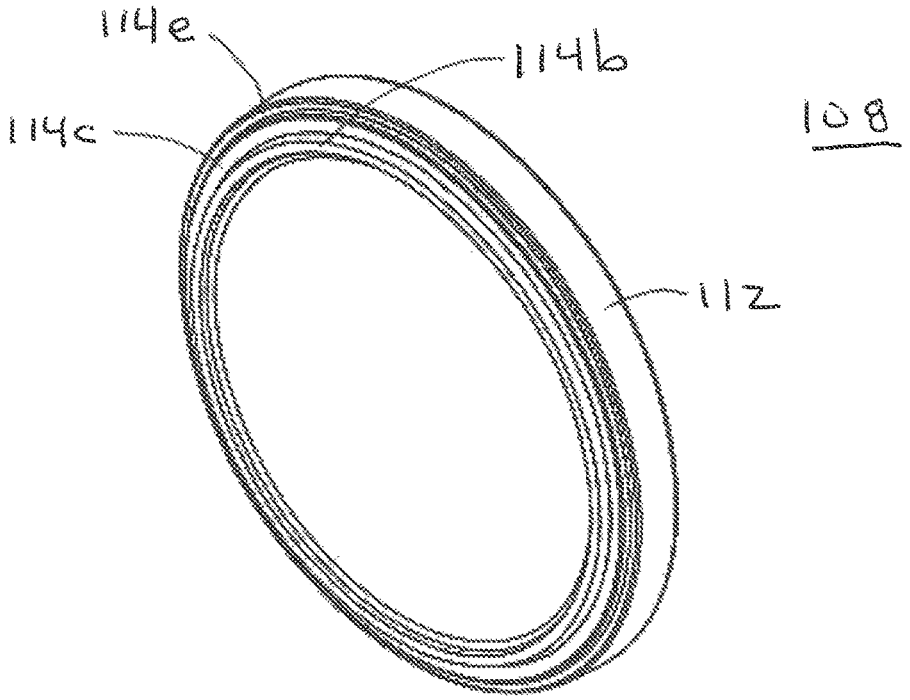
FIG. 3*c* a provides a perspective view of the exemplary plate of FIG. 3*a*.

FIGS. 3*a*, 3*b* and 3*c* together illustrate several novel and unique features of the exemplary plates 108 of FIGS. 1, 2. These features enable the bowls 102*a*, 102*b* and plates 108*a*, 102*b* to be stably positioned in the display position illustrated by FIG. 2. Each plate 114 includes a base 114 surrounded by an upper side wall 112 to define a planar well 110 for holding food products. A base wall 114*a* extends downwardly from the base 114 to terminate at a base footing 114*b* for stably positioning the plate 108 on a flat surface such as a table. A base wall perimeter 114*d* and first annular surface 114*c* define a first shelf on which a rim 102*e* of the bottom large bowl 102*a* may be locatably positioned in the display configuration. A second annular surface 114*e* is positioned radially outwardly and vertically above the first annular surface 114*c* to provide a second shelf on which a upper side wall rim 112*a* of another plate 108 may be locatably positioned in the display configuration as an alternative to positioning the rim 102*c* of the bottom bowl 102*a* on the first shelf.

As illustrated in the cross-sectional view of the plate 108 provided by FIG. 3*b*, upper side wall 112 and planar well 110 in proximity to a planar well perimeter 110*a* form a third shelf for receiving a rim 102*f* to locatably position the top large bowl 102*b* in the display configuration. As illustrated, first, second and third shelves defined by the plate 108 are respectively configured to locate the bottom large bowl 102*a*, the additional plate 108 and the top bowl 102*b*.

In the present example having bowls and plates with circular perimeters as illustrated by FIGS. 1-4, the first, second and third shelves of the each plate 108 are configured to respectively locate the bottom large bow, 102*a*, the additional plate 108 and the top bowl 102*b* so that each of these elements is concentrically aligned with the nested tableware set centerline 101 in the display configuration for the nested tableware set 100. As a result, and as can be seen for the example of FIG. 2, the example display configuration of the nested tableware set 100 exhibits external surface features that are smoothly integrated to define an elongated sphere with a ringlike band defined by the upper side walls 112 of upper and lower plates 108*a*, 108*b* that surrounds an equatorial circumference of the sphere. The sphere is capped at its poles by base walls 102*c*, 102*d* of bottom large bowl 102*a* and top large bowl 102*b*. The assemblage in the display configuration illustrated by FIG. 2 can, for example, be said to be somewhat evocative of a FABERGÉ egg.

Figure 4:
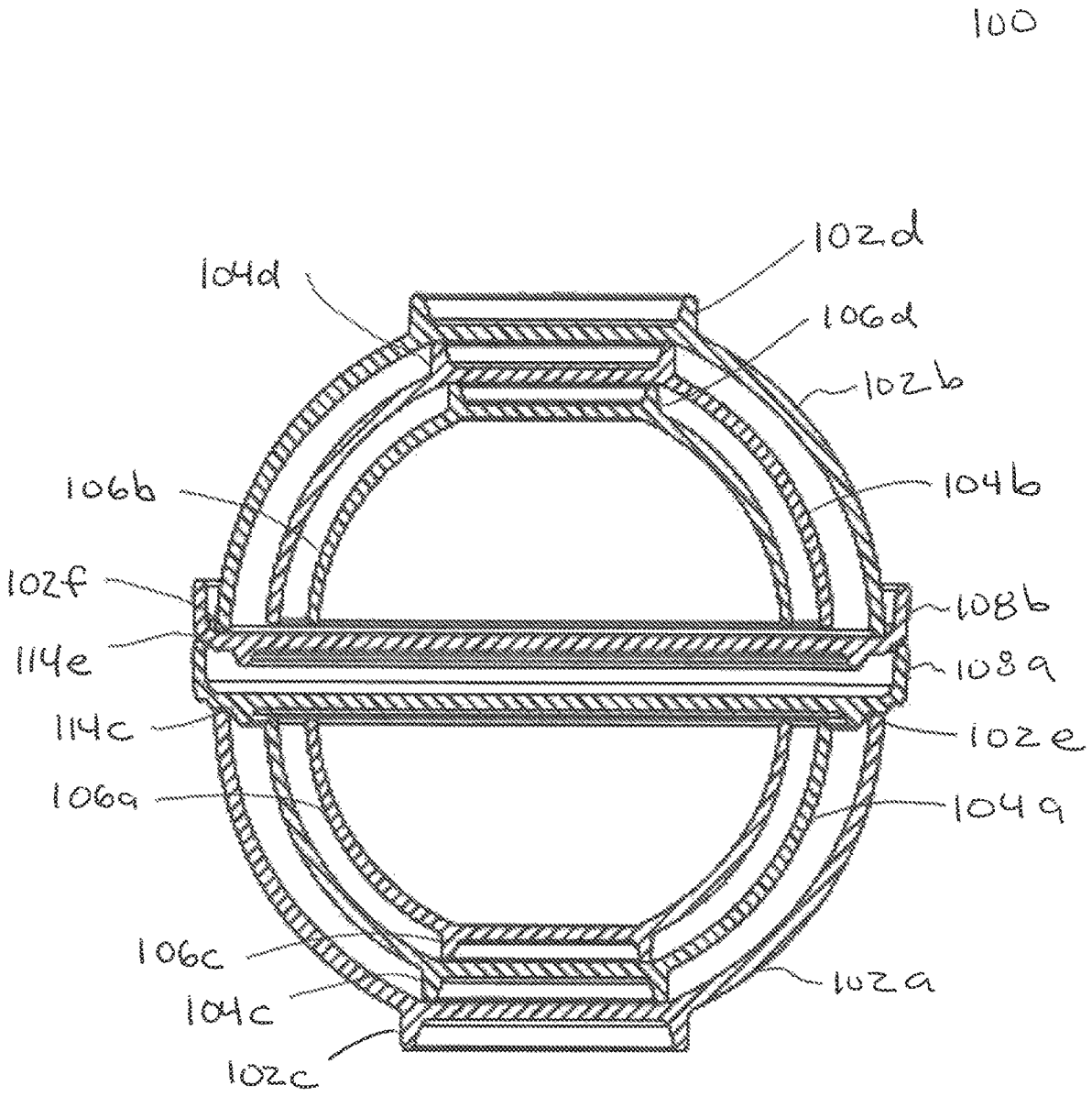
FIG. 4 provides a cross-sectional view of the nested tableware set in the nested state depicted by FIG. 2.

FIG. 4 provides a cross-sectional view of the nested tableware set of FIG. 2. This cross-sectional view illustrates the nested placement of medium bowls 104*a*, 104*b* and small bowls 106*a*, 106*b* within large bowls 102*a*, 102*b*, respectively, in the display configuration. Respective base walls 104*c*, 104*d* of the medium bowls 104*a*, 104*b* separably position the medium bowls 104*a*, 104*b* within large bowls 104*a*, 104*b*, respectively. Similarly, respective base walls 106*c*, 106*d* of the small bowls 106*a*, 106*b* separably position the small bowls 106*a*, 106*b* within the medium bowls 104*a*, 104*b*, respectively. The medium bowls 104*a*, 104*b* and small bowls 106*a*, 106*b* are configured so that, when nested, rims of the respective medium bowls 104*a*, 104*b* and small bowls 106*a*, 106*b* do not extend outwardly of rims 102*e*, 102*f* of the large bowls 102*a*, 102*b*. Preferably, the rims of the respective medium bowls 104*a*, 104*b* and small bowls 106*a* lie inwardly from the rims 102*e*, 102*f* of large bowls 102*a*, 102*b*.

The cross-sectional view of FIG. 4 also illustrates the locatable positioning of large bowls 102*a*, 102*b* with respect to the plates 108*a*, 108*b*. In particular, it can be seen that the rim 102*e* of bottom bowl 102*a* is positioned on the first shelf defined by base wall perimeter 114*d* and first annular surface 114*c*. Upper side wall rim 112*a* of lower plate 108*a* is positioned on the second shelf second annular surface 114*e* of upper plate 108*b*. And the rim 102*f* of the top bowl 102*b* is positioned on the third shelf defined by upper side wall 112 and planar well 110 in proximity to planar well perimeter 110*a*.

It will be understood that, while various aspects of the present disclosure have been illustrated and described by way of example, the invention claimed herein is not limited thereto, but may be otherwise variously embodied within the scope of the following claims. For example, it should be understood that while the example of FIGS. 1-4 illustrate a nested tableware set having two plates and two sets of three nested bowls, configurations with difference numbers of bowls and/or plates are fully contemplated by this disclosure. In addition, while the bowls and plates as illustrated each define a circular circumference or perimeter, bowl and plate perimeters defining other geometric and non-geometric shapes are fully contemplated by this disclosure.

The following table lists the reference characters and names of features and elements used herein: Reference characters assigned to method steps are not listed.

| Ref. char. | Feature or element |
|---|---|
| 100 | Nested Tableware Set |
| 101 | Nested Tableware Set Centerline |
| 102a | Large Bowl (Bottom) |
| 102b | Large Bowl (Top) |
| 102c | Large Bowl Base Wall (Bottom) |
| 102d | Large Bowl Base Wall (Top) |
| 102e | Large Bowl Rim (Bottom) |
| 102f | Large Bowl Rim (Top) |
| 104a | Medium Bowl (Bottom) |
| 104b | Medium Bowl (Top) |
| 104c | Medium Bowl Base Wall (Bottom) |
| 104d | Medium Bowl Base Wall (Top) |
| 106a | Small Bowl (Bottom) |
| 106b | Small Bowl (Top) |
| 106c | Small Bowl Base Wall (Bottom) |
| 106d | Small Bowl Base Wall (Top) |

-continued

| Ref. char. | Feature or element |
|---|---|
| 108a | Lower Plate |
| 108b | Upper Plate |
| 110 | Plate - Planar Well |
| 110a | Plate - Planar Well Perimeter |
| 112 | Plate - Upper Side Wall |
| 112a | Plate - Upper Side Wall Rim |
| 114 | Plate - Base |
| 114a | Plate - Base Wall |
| 114b | Plate - Base Wall Footing |
| 114c | Plate - Base First Annular Surface |
| 114d | Plate - Base Wall Perimeter |
| 114e | Plate - Base Second Annular Surface |

I claim:

1. A nested tableware set, comprising:

upper and lower nested vessel sets, each vessel set including an intermediary vessel nested within an outer vessel and an inner vessel nested within the intermediary vessel, and each vessel having a base supporting a container portion that extends away from the base and terminates at an open rim; and upper and lower plates interposed between the upper and lower vessel sets, each of the upper and lower plates having:

a base outwardly terminating at a side wall, the side wall extending vertically upwardly from an upper surface of the base and terminating at a rim, the upper surface of the base and an inner surface of the side wall defining a well;

a base wall extending vertically downwardly from a lower surface of the base;

a first annular surface extending horizontally along the lower surface of the base and radially outwardly away from an outer surface of the base wall, the first annular surface terminating at an edge extending upwardly from the first annular surface, the first annular surface and the base wall together defining a first shelf; and a second annular surface positioned vertically above the first annular surface and extending horizontally and radially outwardly away from the first annular surface, the second annular surface and the upwardly extending edge of the first annular surface defining a second shelf, wherein the well of each plate defines a third shelf, wherein the second shelf of the upper plate locatably seats the rim of the side wall of the lower plate, wherein the first shelf of the lower plate locatably seats the open rim of the outer vessel of the lower vessel set, wherein the third shelf of the upper plate locatably seats the open rim of the outer vessel of the upper vessel set within the well of the upper plate, wherein the side walls of the upper and lower plates defines a band that extends outwardly from the open rims of the outer vessels of the upper and lower vessel sets, wherein an area of the lower surface of the base defined by the first annular surface of each plate is vertically aligned with an area of the third shelf that is proximate to and extends inwardly away from the inner surface of the side wall.

2. The nested tableware set of claim 1, further comprising at least one intermediate plate positioned between the upper and lower plates.

3. The nested tableware set of claim 2, wherein the side wall rim of the lower plate is seated against the second shelf of a lowest one of the at least one intermediate plate; and the side wall rim of an uppermost one of the at least one intermediate plate is seated against the second shelf of the upper plate.

4. The nested tableware set of claim 1, wherein perimeters defined by the rims of each of the outer vessels of the upper and lower vessel sets are substantially identical.

5. The nested tableware set of claim 4, wherein the vessels of the upper and lower vessel sets and the upper and lower plates are substantially aligned along a common longitudinal axis of the nested tableware set.

6. The nested tableware set of claim 1, wherein the vessels of the upper and lower vessel sets are bowls.

7. The nested tableware set of claim 1, wherein perimeters of the rims of the vessels nested in the upper and lower nested vessel sets and perimeters of the rims of the upper and lower plates are circular.

8. The nested tableware set of claim 1, wherein perimeters of the rims of the vessels nested in the upper and lower nested vessel sets and perimeters of the rims of the upper and lower plates are square.

9. The nested tableware set of claim 1, wherein perimeters of the rims of the vessels nested in the upper and lower nested vessel sets and perimeters of the rims of the upper and lower plates are oval.

* * * * *